US009080510B2

(12) United States Patent
Kuhlbach et al.

(10) Patent No.: US 9,080,510 B2
(45) Date of Patent: Jul. 14, 2015

(54) INTERNAL COMBUSTION ENGINE HAVING AN INTERFERENCE REDUCING EXHAUST MANIFOLD

(75) Inventors: Kai Sebastian Kuhlbach, Bergisch Gladbach (DE); Ludwig Stump, Cologne (DE)

(73) Assignee: Ford Global Techologies, LLC, Dearborn, MI (US)

( * ) Notice: Subject to any disclaimer, the term of this patent is extended or adjusted under 35 U.S.C. 154(b) by 165 days.

(21) Appl. No.: 13/475,675

(22) Filed: May 18, 2012

(65) Prior Publication Data

US 2012/0312002 A1 Dec. 13, 2012

(30) Foreign Application Priority Data

Jun. 10, 2011 (EP) ..... 11169411

(51) Int. Cl.

| | |
|---|---|
| ***F01N 3/00*** | (2006.01) |
| ***F01N 3/02*** | (2006.01) |
| ***F01N 3/10*** | (2006.01) |
| ***F01N 3/20*** | (2006.01) |
| ***F02B 75/20*** | (2006.01) |
| ***F01N 13/10*** | (2010.01) |
| ***F02F 1/24*** | (2006.01) |
| *F02B 27/04* | (2006.01) |
| *F02B 75/18* | (2006.01) |
| *F01N 13/18* | (2010.01) |

(52) U.S. Cl.

CPC ..... *F02B 75/20* (2013.01); *F01N 13/10* (2013.01); *F01N 13/107* (2013.01); *F02F 1/243* (2013.01); *F01N 13/1805* (2013.01); *F02B 27/04* (2013.01); *F02B 2075/1816* (2013.01)

(58) Field of Classification Search

USPC ..... 60/323, 324

See application file for complete search history.

(56) References Cited

U.S. PATENT DOCUMENTS

| | | | | |
|---|---|---|---|---|
| 4,028,887 | A | 6/1977 | Tsutsumi | |
| 5,867,985 | A * | 2/1999 | Furuhashi et al. | 60/323 |
| 8,061,131 | B2 * | 11/2011 | Kuhlbach | 60/323 |
| 8,079,214 | B2 * | 12/2011 | Son et al. | 60/323 |
| 8,146,543 | B2 * | 4/2012 | Kuhlbach et al. | 123/41.82 R |

(Continued)

FOREIGN PATENT DOCUMENTS

| | | | |
|---|---|---|---|
| DE | 3314839 | A1 | 10/1984 |
| DE | 102008035957 | A1 | 2/2010 |

OTHER PUBLICATIONS

Machine Translation DE 33 14 839 done Sep. 11, 2013.*

(Continued)

*Primary Examiner* — Audrey K Bradley
*Assistant Examiner* — Dapinder Singh
(74) *Attorney, Agent, or Firm* — Julia Voutyras; Alleman Hall McCoy Russell & Tuttle LLP

(57) ABSTRACT

An engine having a cylinder head including an exhaust manifold at least partially integrated therein, the exhaust manifold including an inner separating wall fluidly dividing two merged exhaust lines, each merged exhaust line in fluidic communication with a different pair of adjacent cylinders, and an outer separating wall fluidly dividing a first exhaust line in direct fluidic communication with a first cylinder and a second exhaust line in direct communication with a second cylinder, a lateral width of the inner separating wall greater than the outer separating wall, the lateral axis perpendicular to a longitudinal axis traversing centerlines of each cylinder.

16 Claims, 4 Drawing Sheets

(56) References Cited

U.S. PATENT DOCUMENTS

| | | | | |
|---|---|---|---|---|
| 2008/0308050 | A1* | 12/2008 | Kuhlbach et al. ..... | 123/41.82 R |
| 2009/0151343 | A1 | 6/2009 | Son et al. | |
| 2009/0241526 | A1 | 10/2009 | Son et al. | |

OTHER PUBLICATIONS

Kuhlback, Kai et al., "Cylinder Head with Integrated Exhaust Manifold for Downsizing Concepts," MTZ Motortechnische Zeitschrift, vol. 70, No. 4, Apr. 2009, pp. 286-293.

* cited by examiner

INTERNAL COMBUSTION ENGINE HAVING AN INTERFERENCE REDUCING EXHAUST MANIFOLD

CROSS REFERENCE TO RELATED APPLICATION

The present application claims the benefit of and priority to European Patent Application Number 11169411.3, filed on Jun. 10, 2011, the content of which is incorporated herein by reference for all purposes.

BACKGROUND/SUMMARY

The evacuation of the combustion gases from a cylinder in an internal combustion engine during combustion operation may be based on two different mechanisms. When an exhaust valve opens near bottom dead center of the cylinder at the beginning of a combustion cycle, the combustion gases flow at high velocity through an exhaust port into the exhaust system. This is caused by the high pressure level prevailing in the cylinder toward the end of combustion and the associated high pressure difference between the combustion chamber and the exhaust section. This pressure-driven flow process is accompanied by a high pressure peak, which may be referred to as a preliminary exhaust surge and propagates along the exhaust line at the speed of sound, with the pressure degrading (i.e. decreasing) to a greater or lesser extent due to friction with increasing distance traveled and in a manner dependent on the routing of the exhaust lines.

As the combustion cycle progresses, the pressures in the cylinder and in the exhaust line balance each other out to a large extent, and the combustion gases are therefore expelled as a result of the reciprocating motion of the piston.

The dynamic wave processes or pressure fluctuations in the exhaust system in a multi-cylinder internal combustion engine having staggered combustion ignition operation may interfere with one another during the combustion process. This may be referred to as cylinder cross-talk. The interference between the cylinders may result in a reduced torque and power output.

Specifically, the pressure fluctuations in gaseous media propagated as waves passing through the exhaust lines may be reflected at the open or closed ends of the lines. The exhaust flow or local exhaust gas pressure in the exhaust system is then the product of the position of the advancing wave and the reflected wave. In some exhaust systems, the pressure waves emanating from a cylinder pass may pass through the exhaust line corresponding to the cylinder as well as along the exhaust lines of the other cylinders, possibly as far as the exhaust port provided at an end of the respective line.

Exhaust gas which has already been expelled or discharged into an exhaust line during the exhaust and refill process can thus reenter the cylinder, which may be caused by the pressure wave emanating from another cylinder. This interference may reduce the flowrate of exhaust gases from the cylinders into the exhaust lines, thereby degrading combustion operation. As a result, combustion efficiency and/or engine power output may be reduced.

It has been found that combustion operation is degraded, for example, if there is an excess pressure prevailing at the exhaust port of a cylinder or if the pressure wave of another cylinder is propagating in the direction of the exhaust port along the exhaust line toward the end of the exhaust and intake process, counteracting the evacuation of the combustion gases from this cylinder.

Cylinder cross-talk may be particularly prevalent at low engine speeds during valve overlap, when an intake valve is open and an exhaust valve is not yet closed. As a result, the efficiency and power output of the engine may be decreased. Therefore, the size of the engine may be increased to counteract the decreased power output, thereby increasing the size and cost of the engine while increasing the engine's fuel consumption.

Cross-talk may also become particularly problematic in engines having integrated exhaust manifolds. Specifically, in an integrated exhaust manifold all of the exhaust lines may be merged into a single conduit in the cylinder head, reducing the length travelled by exhaust gases through separate exhaust lines. As a result, the problem of mutual interference between the cylinders during the combustion process may be exacerbated.

Attempts have been made to reduce interference in engines having integrated exhaust manifolds by increasing the width of the cylinder head. However, widening the cylinder head may have adverse affects on the vehicle's impact absorbing characteristics. For example, free space in the engine compartment for deformation of the vehicle may be needed to achieve desired impact absorbing characteristics. However, widening the cylinder head reduces the space in the engine compartment.

Other, attempts have been made to reduce cross-talk by increasing the length of individual exhaust lines fluidly separated from other each-other in an engine having an exhaust manifold positioned outside of the cylinder head. However, this may increase the size of the engine as well as negatively affect turbocharger operation and catalyst operation.

As such in one approach, an engine having a cylinder head including an exhaust manifold at least partially integrated therein, the exhaust manifold including an inner separating wall fluidly dividing two merged exhaust lines, each merged exhaust line in fluidic communication with a different pair of adjacent cylinders, and an outer separating wall fluidly dividing a first exhaust line in direct fluidic communication with a first cylinder and a second exhaust line in direct communication with a second cylinder, a lateral width of the inner separating wall greater than the outer separating wall, the lateral axis perpendicular to a longitudinal axis traversing centerlines of each cylinder. It has been unexpectedly found that cross-talk between the cylinders in a cylinder head having these geometric characteristics is reduced while at least partially integrating the exhaust manifold into the cylinder head. As a result, a desired amount of engine compactness may be achieved while at the same time reducing interference between the cylinders caused by pressure fluctuations.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

The invention is described in greater detail below with reference to three embodiments in accordance with FIGS. 1 to 4.

DETAILED DESCRIPTION

Figure 1:
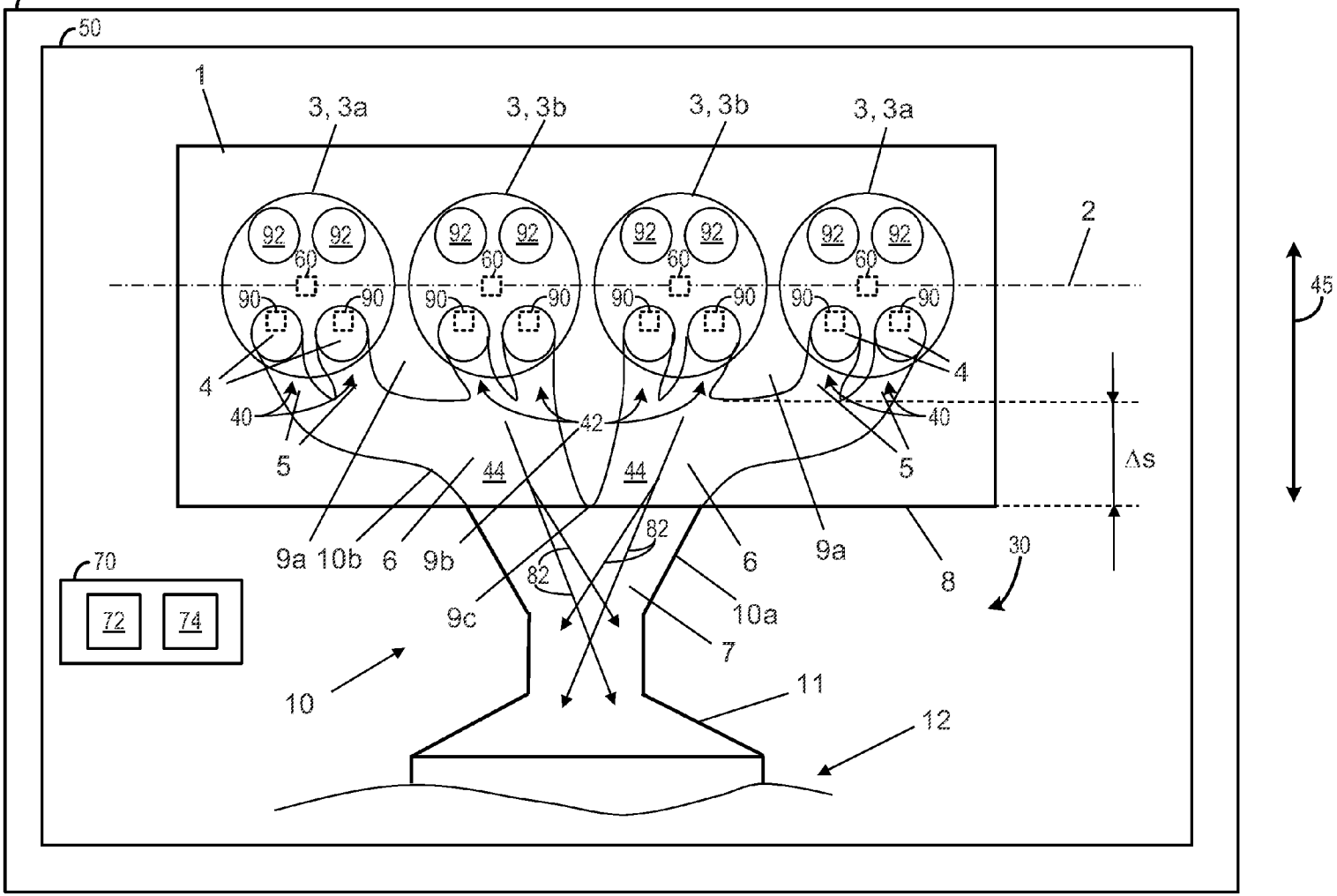
FIG. 1 shows schematically a first embodiment of a cylinder head in cross-section.

FIG. 1 shows schematically a first embodiment of an internal combustion engine 50. The engine 50 may be included in a vehicle 100. Specifically, a cross-section of a cylinder head 1, a turbine 12, and an inlet 11 of the turbine 12 is illustrated in FIG. 1. Although one cylinder head is depicted it will be appreciated that in other embodiments the engine 50 may include a second cylinder head having a similar configuration to the cylinder head 1. Thus, the engine 50 may include a second bank of cylinders in some embodiments.

The cylinder head 1 may be connected to a cylinder block to form combustion chambers. The cylinder block may include cylinder bores to accommodate pistons and cylinder liners. The pistons may be guided for axial motion in the cylinder liners and, together with the cylinder liners and the cylinder head.

The internal combustion engine 50 may be operated by a process involving four strokes (e.g., an intake stroke, a compression stroke, a power stroke, and an exhaust stroke). Specifically during an exhaust stroke, the combustion gases may be expelled via the exhaust ports of the at least four cylinders, and the combustion chambers subsequently filled with a fresh mixture or charge air via the intake ports in an intake stroke. In order to control the exhaust and intake process, the internal combustion engine 50 may include valves and valve actuating components. Specifically, to control the exhaust and intake process, reciprocating valves may be used as control members in the engine. The valves may be configured to perform an oscillating stroke motion during the operation of the internal combustion engine and in this way opening and closing the intake and exhaust ports. The valve actuating mechanism for actuating the valves may be valve gear(s). Furthermore, the valve actuating mechanisms may be positioned in the cylinder head.

The valve gears may be configured to open and close the intake and exhaust valves at desired intervals. Thus, variable valve timing may be used. However, in other examples variable valve timing may not be utilized. In some examples, the valve gears may be configured to rapidly open the valves to reduce the throttling losses in the inflowing and outflowing gas streams. Moreover, the valve gears may be configured to actuate the valves to fill of the combustion chambers with a fresh air/fuel mixture and remove the exhaust gas from the combustion chambers.

The cylinder head 1 may have an integrated coolant jacket. The coolant jacket may be sized to meet the cooling requirements of the engine. It will be appreciated that if the engine 50 includes a turbocharger the cooling requirements may be increased. The coolant jacket may be included in a liquid cooling system. However, in other examples the engine 50 may be air cooled. It will be appreciated that liquid cooling systems may be able to remove more heat from the engine than air cooling systems. The coolant jacket may include coolant ducts which carry the coolant through the cylinder head and/or cylinder block (not shown). Therefore, heat may be transferred to the coolant (e.g., water with additives) in the cylinder head. The coolant may be delivered to the coolant jacket via a pump arranged in the cooling circuit, and therefore circulates within the coolant jacket. A heat exchanger may also be included in the coolant circuit. The heat exchanger may be configured to transfer the heat removed from the cylinder head to the surrounding environment.

Additionally, the cylinder head 1 has four cylinders 3, in the embodiment depicted in FIG. 1. However, cylinder heads having a different number of cylinders may be used in other embodiments. The cylinders 3 are arranged along the longitudinal axis 2 of the cylinder head 1. Thus, the cylinders are arranged in series. Cylinders arranged in such a manner may be referred to as an inline cylinder configuration. Therefore, the cylinder head 1 has two outer cylinders 3*a* and two inner cylinders 3*b*.

Each of the cylinders 3 may include an ignition device for initiating combustion in the cylinder. The ignition devices are indicated via boxes 60 and may not be located in the cross-section shown in FIG. 1. For example, each of the ignition devices may be positioned adjacent to a top of each cylinder. The ignition devices may be spark plugs. However, in other embodiments compression ignition may be used to initiate combustion. The ignition devices may be controlled by a controller 70 including memory 72 executable by a processor 74. Instructions, such an ignition timing method may be stored in the memory 72. Specifically, the method shown in FIG. 4 may be stored in the memory 72.

Each of the cylinders 3 includes two intake ports 92, in the embodiment depicted in FIG. 1. However, cylinders having another number of ports have been contemplated. Intake valves may be positioned in the intake ports for opening and closing the ports to perform combustion in the cylinders 3, as previously discussed. Intake valve actuating mechanisms (e.g., cams, electronically controlled solenoids, etc.,) may also be included in the engine 50.

Furthermore, each cylinder 3 has two exhaust ports 4, in the depicted embodiment. The exhaust ports 4 enable exhaust gas to be discharged into an exhaust system 30 from the cylinders 3. When two ports are used per cylinder as opposed to one port per cylinder, the time interval needed for flowing exhaust gas from the cylinders into the exhaust system is reduced, thereby decreasing throttling losses. However, the cylinders may have an alternate number of exhaust ports in other embodiments. It will be appreciated that each of the exhaust ports 4 may have a corresponding exhaust valve, indicated generically via boxes 90, and valve actuating mechanism (e.g., cams, electronically controlled solenoids, etc.,) configured to cyclically open and close during engine operation, to enable combustion. It will be appreciated that a closed valve may inhibit combustion gases from flowing into downstream exhaust lines in the exhaust system. On the other hand an open valve permits combustion gasses to flow into downstream exhaust lines in the exhaust system.

The exhaust ports 4 are adjoined by exhaust lines 5 included in the exhaust system 30 configured to discharge exhaust gases into the surrounding environment. That is to say, that each exhaust port 4 is in fluidic communication with an exhaust line 5 positioned directly downstream of the exhaust port. Directly downstream means that there no intermediary components positioned between the exhaust port and the exhaust line in the exhaust stream. The exhaust lines 5 of the cylinders 3 come together in stages to form an exhaust gas collector 7. In this way, the exhaust lines 5 are brought together to form a single conduit. Thus, the exhaust gas collector is a common exhaust line and is in fluidic communication with upstream exhaust lines. The two exhaust lines 5 corresponding to outer cylinders 3*a* and the two exhaust lines 5 corresponding to the inner cylinders 3*b* in each case coming together to form a merged exhaust line 6 upstream of the exhaust gas collector 7. Arrows 82 denote the general exhaust gas flow direction in an exhaust manifold 10. Thus, an exhaust line from an outer cylinder and an exhaust line from an inner cylinder fluidly merge at a confluence to form a single merged exhaust line. It will be appreciated that the depicted engine includes two merged exhaust lines. In this way, the exhaust lines 5 from the corresponding pairs of outer and inner cylinders may come together to form a merged exhaust line in a first stage. In a second stage, the merged exhaust lines are then brought together downstream in the exhaust system to form the exhaust gas collector 7. When the exhaust lines are merged in this way, the length of the exhaust lines may be shortened when compared to exhaust manifolds positioned external to the cylinder head. As a result, the compactness of the engine may be increased. Further, it has been found unexpectedly that the cross-talk between the cylinders during engine operation is substantially reduced when the exhaust lines are merged in stages. As a result, combustion operation is improved. Thus, the length of the exhaust manifold can be reduced without exacerbating cross-talk between the cylinders.

The exhaust lines 5, merged exhaust lines 6, exhaust gas collector 7, and/or exhaust ports 4 may be included in the exhaust manifold 10. Therefore, the exhaust manifold 10 includes a combination of exhaust lines from multiple cylinders converging in stages and finally converging into a single conduit (e.g., exhaust gas collector 7). When the exhaust lines are merged in this way in the exhaust manifold a significant reduction in the total length of all the exhaust lines and hence in the volume of the manifold may be achieved when compared to exhaust manifolds which may merge all of the exhaust lines into a single collector at once. The exhaust manifold 10 may be at least partially integrated into the cylinder head 1.

The integration or partial integration of the exhaust manifold 10 into the cylinder head 1 increases the compactness of the engine when compared to engines which may position the exhaust manifold exterior to the cylinder head. As a result, the entire drive unit in the engine compartment may be densely packaged. Moreover, the integration of the exhaust manifold into the cylinder head may also reduce the cost of production and assembly as well as reduced the weight of the engine.

Furthermore, integrating or partially integration the exhaust manifold into the cylinder head may also improve operation of an exhaust gas aftertreatment system provided downstream of the manifold. For example, it may be desirable to reduce the length between the cylinders and exhaust treatment devices (e.g., a catalyst) to reduce temperature losses in the exhaust gas. In this way, the exhaust treatment device may reach a desired operating temperature more quickly during for example a cold start. It will be appreciated that when the distance between the cylinders and an exhaust gas aftertreatment device is reduce, the thermal inertia of the exhaust manifold is reduced. Furthermore, the exhaust manifold 10 may emerge from an outer side of the cylinder 1 and is discussed in greater detail herein.

A section 40 of each of the two exhaust lines 5 corresponding to the outer cylinders 3*a* and a section 42 of each of the two exhaust lines 5 corresponding to the inner cylinders 3*b* are in each case separated from one another by an outer separating wall 9*a*, which extends into the exhaust system 30. In this way, the outer separating walls divide exhaust lines corresponding to different cylinders. Thus, the outer separating walls 9*a* are included in the exhaust system 30. The outer separating walls 9*a* each include a first stage confluence at the lateral end of the wall closest to the exterior side-wall 8. The confluence is where the exhaust lines from separate cylinders merge.

Furthermore, sections 44 of the two merged exhaust lines 6 are separated from one another by an inner separating wall 9*b* which extends into the exhaust system 30. Thus, the merged exhaust lines 6 are divided by the inner separating wall 9*b*. It will be appreciated that the exhaust lines associated with the two inner cylinders 3*b* are also separated via the inner separating wall 9*b*. The inner separating wall 9*b* includes an end 9*c*. The end 9*c* is a second stage confluence. The inner separating wall 9*b* is included in the exhaust system 30. Both the inner separating wall 9*b* and the outer separating walls 9*a* are formed integrally with the cylinder head 1. That is to say, that the inner separating wall 9*b* and the outer separating wall 9*a* are included (e.g., integrated into) in the cylinder head 1.

The inner separating wall 9*b* extends a greater distance towards the exterior side-wall 8 than the outer separating walls 9*a*. Thus, the inner separating wall 9*b* has a greater lateral width than each of the outer separating walls 9*a*. A lateral axis 45 is provided for reference. Specifically, the inner separating wall 9*b* extends further in the direction of the exterior side-wall 8 of the cylinder head 1—perpendicularly to the longitudinal axis 2 of the cylinder head 1—than the outer separating walls 9*a* by a distance Δs. Therefore, the difference in the lateral widths of the inner separating wall 9*b* and each of the outer separating walls 9*a* is Δs. In other words, the inner separating wall 9*b* extends beyond the outer separating walls 9*a* by the distance Δs in a lateral direction. Δs may be greater than or equal to 5 and/or 10 millimeters (mm), in some embodiments.

It has been found unexpectedly that when the inner separating wall 9*b* and the outer separating walls 9*a* are arranged in this way (for example with the particular dimensions mentioned herein) the mutual interference between cylinders is reduced. In other words, the cross-talk caused by waves generated via combustion operation in the cylinders and propagated in the exhaust system between cylinders is substantially reduced. In particular, the interference between the first and second pairs of adjacent inner and outer cylinders may be substantially reduced. As a result, combustion operation may be improved, thereby increasing combustion efficiency and therefore the power output of the engine.

Specifically, computer-based simulations have shown that desired torque characteristic may be achieved in an engine having the inner separating wall extending 5 mm or more beyond the outer separating wall in a lateral direction. It will be appreciated that the points on the separating walls which project furthest in a downstream direction into the exhaust system may be used as reference points to measure the difference between the separating walls. In other words, the points laterally closest to the exterior side-wall 8 may be used as reference points. It will be appreciated that as Δs increases the more pronounced is the separation of the two merged exhaust lines from one another in terms of distance and the more clearly noticeable is the effect thereby achieved that the cylinder groups do not interfere with one another, or interfere to a lesser degree with one another, and in particular do not hinder one another during the combustion operation in the engine. It will be appreciated that Δs may be selected based on its interference reduction characteristics as well as a desired cylinder head and engine compactness.

In the embodiment illustrated in FIG. 1, the end 9*c* of the inner separating wall 9*b* extends to the exterior side-wall 8 of the cylinder head 1. The end 9*c* is the point where the gases from the separate exhaust streams converge. In this way, the exhaust streams in the merged exhaust lines 6 are separated from one another by the inner separating wall 9*b* until they leave the cylinder head 1. Thus, the exhaust gasses from the exhaust system flow out of cylinder head 1 via two exhaust outlets.

The exhaust lines 5 corresponding to each of the cylinders 3 and the merged exhaust lines 6 of the cylinder pairs are brought together to form an exhaust gas collector 7 outside the cylinder head 1. Thus, the exhaust gas collector 7 is positioned in the exhaust system 30 exterior to the cylinder head 1 in the embodiment depicted in FIG. 1. However, other exhaust gas collector locations have been contemplated, such as at a location inside the cylinder head 1.

The exhaust lines 5, the merged exhaust lines 6, exhaust gas collector 7, the inner separating walls 9*b*, and/or the outer separating walls 9*a* may be included in the exhaust manifold 10. Thus, the exhaust manifold includes a combination of exhaust lines from multiple cylinders converging into a single conduit. The exhaust ports 4 may also be included in the exhaust manifold 10, in some embodiments. The exhaust manifold 10 may be arranged upstream of the turbine 12. Additionally, the exhaust manifold 10 may include the exhaust lines upstream of the turbine in the exhaust system. However, in some embodiments the inlet region of the turbine may be included in the exhaust manifold. A section 10*a* of the exhaust manifold 10 is included in the cylinder head 1 and a second 10*b* of the exhaust manifold is positioned external to the cylinder head.

Figure 2:
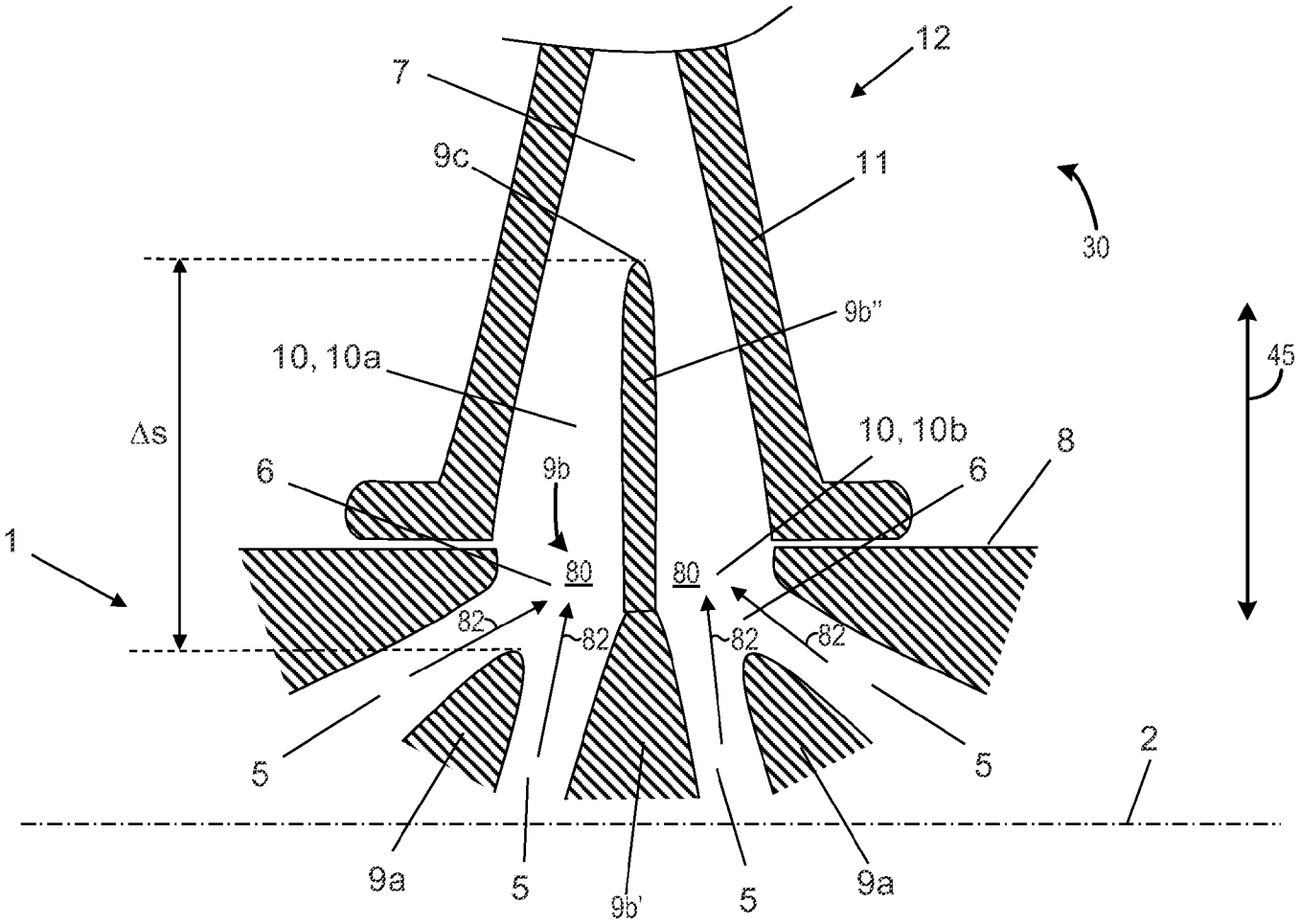
FIG. 2 shows schematically a second embodiment of the cylinder head in cross-section.

In the embodiment depicted in FIG. 2 the exhaust manifold 10 is only partially integrated into the cylinder head 1. Again, the exhaust manifold 10 includes the section 10*b* positioned in the cylinder head 1 and the section 10*a* positioned outside of the cylinder head. The section 10*b* may be referred to as an interior manifold section and the section 10*a* may be referred to as an exterior manifold section.

The turbine 12 of an exhaust turbocharger has an inlet 11 in fluidic communication with and integrated into the exhaust gas collector 7. In this way, exhaust gas may flow from the exhaust gas collector to the downstream turbine. Specifically, the inlet 11 is in direct fluidic communication with the exhaust gas collector 7. In other words, there are no components between the exhaust gas collector and the inlet of the turbine in the exhaust system 30. In this way, the distance traveled by the exhaust gas in the exhaust system and the volume of the exhaust manifold is reduced, thereby increasing the system's efficiency. Moreover, the response time of the turbine after a change in engine output is decreased. However, in other embodiments there may be intermediary components between the inlet of the turbine and the exhaust gas collector.

In some examples, the exhaust gas collector 7 merges smoothly into the inlet 11. That is to say that a wall of the exhaust gas collector may be continuous with the inlet of the turbine.

The firing order (e.g., ignition sequence) of the cylinders may be selected to further reduce cross-talk between the cylinders during engine operation. When the internal combustion engine 50 having spark ignition an ignition sequence of 1-2-4-3 may be used for initiating combustion in the cylinders. It will be appreciated that the numbering of the cylinder in an inline cylinder bank may start with an outer cylinder (e.g., an outer cylinder facing the clutch) and travel sequentially down the cylinder bank in a longitudinal direction. Exemplary numbering of the cylinders in an internal combustion engine is shown in DIN 73021. Specifically in some examples, the cylinders may be ignited at intervals spaced by approximately 180° of crank angle. Therefore in some examples, starting from the first cylinder, the ignition times, measured in degrees of crank angle, may be as follows: 0-180-360-540. In contrast to other cylinder firing patterns, the cylinders in the cylinder group are fired immediately in succession in the aforementioned case, and these cylinders thus have a thermodynamic offset of 180° of crank angle. When the cylinders are fired in the aforementioned pattern the cross-talk between the cylinders may be further reduced. However, in other embodiments other suitable ignition sequences may be used, such as an ignition sequence of 1-3-4-2.

FIG. 2 shows a second embodiment of the cylinder head 1 together with a section of the inlet 11 of a turbine 12. It will be appreciated that a cross-sectional view of the cylinder head 1 is shown in FIG. 2. The differences with respect to the embodiment illustrated in FIG. 1 are discussed, for which reason reference will be made in other respects to FIG. 1. Identical reference numerals have been used for similar components.

In contrast to the embodiment shown in FIG. 1, the inner separating wall 9*b* in the embodiment illustrated in FIG. 2 extends beyond the exterior side-wall 8 of the cylinder head 1 and into the inlet 11 of the turbine 12.

The inner separating wall 9*b* may have a modular construction. That is to say, that the inner separating wall 9*b* includes a plurality of sections which may be separately manufactured and subsequently coupled to one another. However, in other embodiments, the inner separating wall 9*b* may not be separately manufactured. As shown in FIG. 2, the inner separating wall 9*b* may include a first section 9*b*' and a second section 9*b*" extending into the inlet 11 of the turbine 12. However, the second section 9*b*" may be integrated into another suitable component in the exhaust system, such as an exhaust conduit. Additionally, the turbine 12 may include a rotor assembly (not shown) and may be rotationally coupled to a compressor positioned in an intake system of the engine and configured to increase the intake air pressure. Thus, the turbine 12 may be included in a turbocharger. It will be appreciated that the turbine 12 is in fluidic communication with each of the cylinders 3, shown in FIG. 1. It will be appreciated that a turbocharger has several benefits over mechanical driven chargers (e.g., supercharger). For example, a supercharger requires energy generated from the engine to operate. For example, the supercharger may be driven via the crankshaft or via electricity generated in the engine. In contrast, the turbocharger uses exhaust gas energy to operate.

In the turbocharger, the energy transferred to the turbine from the exhaust stream may be used to drive a compressor, which transports and compresses the charge air fed to it, and pressure charging of the cylinders is thereby achieved. A charge air cooler configured to remove heat from the intake air downstream of the compressor may also be used in the engine. Pressure charging via the turbocharger may boost the power of the internal combustion engine. However, pressure charging may also decrease fuel consumption in the engine while producing a desired amount of power.

In some examples, the turbine may include a wastegate for directing exhaust gas around the turbine to provide desired torque characteristics in the engine. The wastegate may be configured to direct exhaust gas around the turbine when the exhaust gas flow exceeds a predetermined value. Further in other embodiments, a plurality of turbochargers may be included in the engine which may be arranged in series or parallel.

The turbine can furthermore be provided with variable turbine geometry, which allows a larger degree of adaptation to the respective operating point of the internal combustion engine through adjustment of the turbine geometry or of the effective turbine cross section. In this case, adjustable guide vanes for influencing the direction of flow may be arranged in the inlet region of the turbine. If the turbine has a fixed geometry the guide vanes may be arranged in a stationary manner but also may be arranged in an immovable manner (e.g., rigidly fixed) in the turbine inlet. In the case of variable geometry, in contrast, the guide vanes may be arranged in a stationary manner but are not completely immovable, being pivotable about their axis to enable the inlet flow to the guide vanes to be influenced.

Continuing with FIG. 2, it will be appreciated that the second section 9*b*" may be included in an external manifold section. Furthermore, in the depicted embodiment exhaust gas flows from the cylinder head 1 in the form of two outlets 80. Arrows 82 depict the general flow of exhaust gas through the exhaust manifold 10. It will be appreciated that the outlets 80 are fluidly separated. That is to say the exhaust gas cannot flow therebetween. The two exhaust streams continue to be separated by the inner separating wall section 9*b*", even after it leaves the cylinder head 1. In the present case, the exhaust gas collector 7 integrated into the inlet of the turbine 12. Thus, the exhaust gas collector 7 is positioned outside the cylinder head 1. In this way, the distance traveled by the exhaust gas between the cylinders and the turbine is reduced thereby increasing the efficiency of the exhaust system. As a result, the speed of the turbine may be increased during engine operation, thereby increasing the power output of the engine.

The end 9*c* of the second section 9*b*", which extends into the inlet 11, is positioned at a distance from the exterior side-wall 8 of the cylinder head 1, for which reason the section 9*b*" formed by the inlet 11 projects into the cylinder head 1 to enable the first section 9*b*' to be continued. It will be appreciated that the second section 9*b*" may extend a predetermined distance outside of the cylinder head 1 to achieve desired torque characteristic in the engine.

Figure 3:
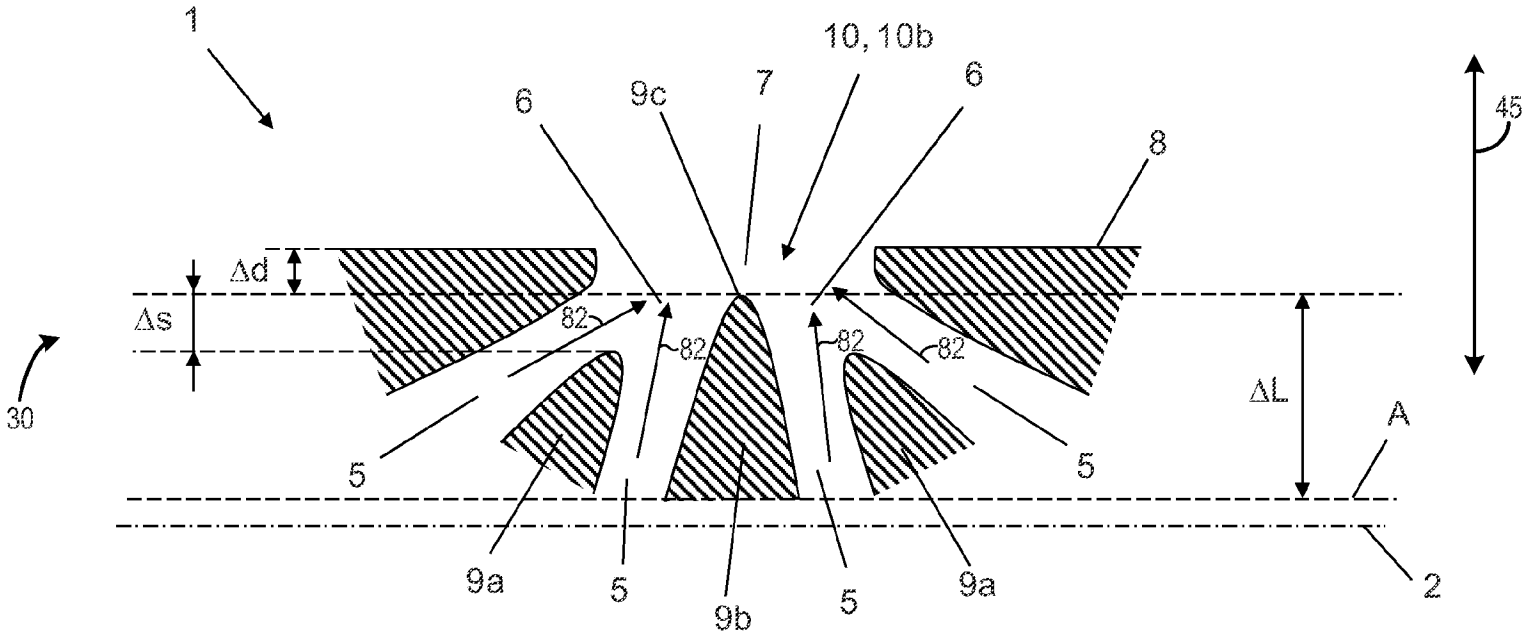
FIG. 3 shows schematically a third embodiment of the cylinder head in cross-section.

FIG. 3 shows schematically and in cross-section a third embodiment of the cylinder head 1. The differences with respect to the embodiment illustrated in FIG. 1 are discussed, for which reason reference will be made in other respects to FIG. 1. Identical reference numerals have been used for similar components.

In contrast to the embodiment in FIG. 1, the inner separating wall 9*b* in the embodiment illustrated in FIG. 3 does not extend as far as the exterior side-wall 8 of the cylinder head 1. Rather, the end 9*c* of the inner separating wall 9*b* is at a distance Δd from the exterior side-wall 8 of the cylinder head 1. Arrows 82 denote the general direction of exhaust gas flow in the exhaust manifold 10.

Consequently, the exhaust lines 5 of the cylinders 3 come together to form the exhaust gas collector 7 within the cylinder head 1 itself, thereby forming an integrated exhaust manifold 10. The exhaust system emerges from the cylinder head 1 in the form of a single opening.

As shown in FIG. 3, the end 9*c* of the inner separating wall 9*b*, projects into the exhaust system, at a distance Δd, perpendicularly to the longitudinal axis of the at least one cylinder head, from the outer side of the at least one cylinder head. Therefore, it will be appreciated that Δd is measured along the lateral axis 45. In some examples, Δd≤30 mm and/or Δd≤20 mm. Further in some examples, Δd≥10 mm.

It is inherent in the embodiment shown in FIG. 3 that the exhaust lines formed in the cylinder head are brought together to form an exhaust gas collector within the cylinder head itself. Thus, the exhaust gas carried by the exhaust system leaves the cylinder head through a single exhaust conduit on the exhaust-side outer side of the cylinder head. In this way, the compactness of the engine may be increased. However, due to the geometry of the inner separating wall 9*b* the interference between the cylinders may be reduced.

Additionally, the end 9*c* of the inner separating wall 9*b* is at a perpendicular distance ΔL from a plane A, which runs parallel to the exterior side-wall 8 of the cylinder head 1 and through the exhaust ports 4 of the cylinders. Specifically, plane A may intersect the center lines of the exhaust ports 4. Thus, ΔL also measures a lateral width. In some examples, ΔL≥D, in which D is the diameter of a cylinder. In some examples, plane A is parallel to the exterior side-wall 8 of the cylinder head 1. However, in other examples the plane A may not be parallel to the exterior side-wall. Plane A is also perpendicular to the lateral axis 45 and therefore parallel to a longitudinal axis. In some embodiments, ΔL≥1.2D. The magnitude of ΔL determines the distance over which the exhaust streams in the merged exhaust lines 6 are separated from one another. The greater the distance ΔL chosen, the greater are the lengths of the merged exhaust lines and the less the cylinders can interfere with one another during combustion operation. It will be appreciated that ΔL may be selected based on the cylinder interference reduction characteristics as well as the desired compactness of the cylinder head and the engine. When ΔL≥1.2D desired amount of cylinder interference reduction and compactness may be achieved.

Figure 4:
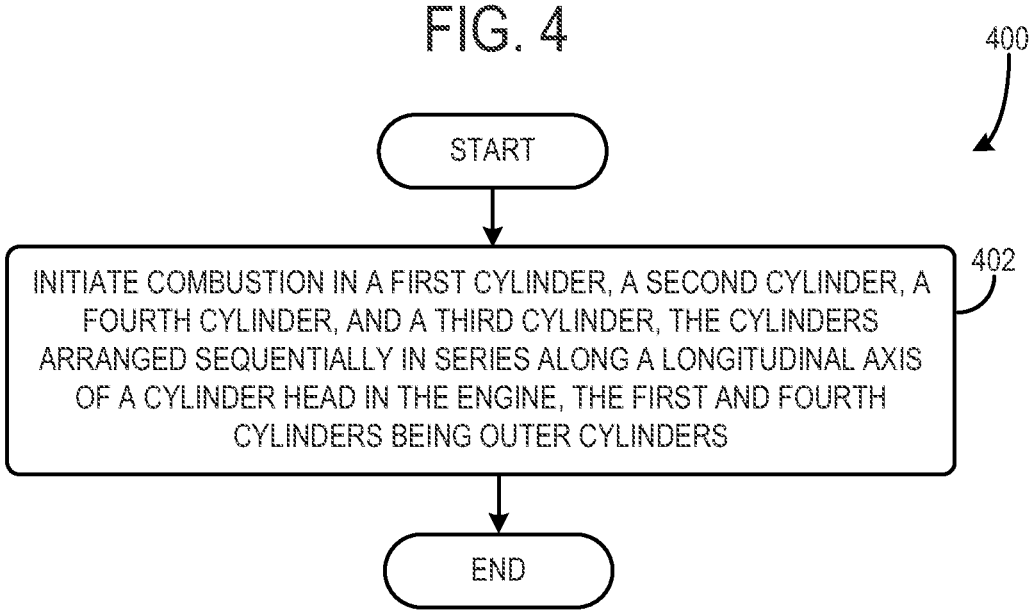
FIG. 4 shows a method for operation of an internal combustion engine.

FIG. 4 shows a method 400 for operation of an internal combustion engine. It will be appreciated that method 400 may be implemented by the engine described above with regard to FIGS. 1-3 or may be implemented by another suitable engine.

At 402 the method includes initiating combustion in a first cylinder, a second cylinder, a fourth cylinder, and a third cylinder, the cylinders arranged sequentially in series along a longitudinal axis of a cylinder head in the engine, the first and fourth cylinders being outer cylinders.

It will be appreciated by those skilled in the art that although the invention has been described by way of example with reference to one or more embodiments it is not limited to the disclosed embodiments and that alternative embodiments could be constructed without departing from the scope of the invention as defined by the appended claims.

The invention claimed is:

1. An internal combustion engine comprising:

a cylinder head including four cylinders arranged in series along a longitudinal axis of the cylinder head and an exterior side-wall; and an exhaust system including, for each cylinder, an exhaust port in fluidic communication with the cylinder and an exhaust line, each of the exhaust lines merging in stages forming an exhaust manifold, the exhaust lines associated with a first outer cylinder and a first inner cylinder fluidly converging to form a first merged exhaust line and the exhaust lines associated with a second inner cylinder and a second outer cylinder fluidly converging to form a second merged exhaust line, the first and second merged exhaust lines exit the cylinder head via two exhaust outlets and fluidly converge downstream and outside the cylinder head to form an exhaust gas collector, at least a portion of the exhaust manifold is integrated into the cylinder head and extends through the exterior side-wall, the exhaust manifold including an outer separating wall fluidly dividing the exhaust line corresponding to the first inner cylinder from the exhaust line corresponding to the first outer cylinder and an inner separating wall fluidly dividing the exhaust line associated with the first inner cylinder from the exhaust line associated with the second inner cylinder, the inner separating wall having a greater lateral width than the outer separating wall, the lateral axis perpendicular to the longitudinal axis.

2. The engine of claim 1, where the difference between the lateral widths of the inner separating wall and the outer separating wall is ≥10 millimeters (mm), where an end of the inner separating wall is located at a lateral distance Ad from the exterior side-wall, where Δd≤30 millimeters (mm), where Δd≤20 mm, where Δd≤10 mm, where the end is positioned at lateral distance ΔL from a plane A, plane A parallel to the longitudinal axis and extends through each of the exhaust ports, where ΔL≥a diameter of each cylinder (D), and wherein ΔL≥1.2D.

3. The engine of claim 1, where the exhaust gas collector is positioned outside of the cylinder head.

4. The engine of claim 1, where the inner separating wall extends to the exterior side-wall.

5. The engine of claim 1, wherein the inner separating wall extends beyond the exterior side-wall in a lateral direction.

6. The engine of claim 1, further comprising a turbine having an inlet in fluidic communication with the exhaust gas collector, where the inner separating wall extends into the inlet.

7. The engine of claim 1, where the inner separating wall has a modular construction including a first section positioned in an inlet of a turbine in fluidic communication with the exhaust gas collector and a second section positioned in the cylinder head.

8. The engine of claim 1, where the inner separating wall is integrated into the cylinder head.

9. The engine of claim 1, where the inner separating wall has a modular construction including a first section positioned in the cylinder head and a second section positioned outside of the cylinder head.

10. The engine of claim 1, further comprising a controller configured to initiate sequential combustion in the first outer cylinder, the first inner cylinder adjacent to the first outer cylinder, the second outer cylinder, and the second inner cylinder.

11. The engine claim 1, where the exterior side-wall is parallel to the longitudinal axis.

12. The engine of claim 11, where the difference between the lateral widths of the inner separating wall and the outer separating wall is ≥5 millimeters (mm).

13. An internal combustion engine comprising:

a cylinder head including a first inner cylinder, a second inner cylinder, a first outer cylinder, a second outer cylinder, and an exterior side-wall, the cylinders arranged in series along a longitudinal axis of the cylinder head; and an exhaust manifold at least partially integrated into the cylinder head including a plurality of exhaust lines, each of the cylinders in fluidic communication with one of the exhaust lines, the exhaust lines from pairs of adjacent inner and outer cylinders fluidly combining at first stage confluences to form merged exhaust lines, the merged exhaust lines exiting the cylinder head via two exhaust outlets and fluidly combining at a second stage confluence to form an exhaust gas collector, the second stage confluence positioned outside the cylinder head.

14. The engine of claim 13, where the exhaust as collector is in fluidic communication with an inlet of a turbine.

15. The engine of claim 13, where the two exhaust outlets are positioned in a horizontal, side-by-side manner.

16. The engine of claim 13, where the exhaust lines extend from the cylinders in a single direction along a lateral axis perpendicular to the longitudinal axis of the cylinder head.

* * * * *